US009610793B2

(12) United States Patent
Igarashi

(10) Patent No.: US 9,610,793 B2
(45) Date of Patent: Apr. 4, 2017

(54) SHEET DETERMINING METHOD AND PRINTING APPARATUS

(71) Applicant: CANON KABUSHIKI KAISHA, Tokyo (JP)

(72) Inventor: Yuki Igarashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/681,598

(22) Filed: Apr. 8, 2015

(65) Prior Publication Data

US 2015/0290956 A1 Oct. 15, 2015

(30) Foreign Application Priority Data

Apr. 14, 2014 (JP) ..... 2014-082940

(51) Int. Cl.
*B41J 11/00* (2006.01)
*B41J 29/393* (2006.01)

(52) U.S. Cl.
CPC ..... *B41J 29/393* (2013.01); *B41J 11/009* (2013.01)

(58) Field of Classification Search
CPC ..... B41J 11/009
See application file for complete search history.

(56) References Cited

U.S. PATENT DOCUMENTS

2002/0130942 A1* 9/2002 Walker ..... B41J 2/125 347/105
2004/0257942 A1* 12/2004 Higashiyama ..... B41J 11/0095 369/53.2
2005/0040348 A1* 2/2005 Soar ..... B41J 11/009 250/559.11
2005/0110822 A1* 5/2005 Hwang ..... B41J 11/009 347/19
2005/0276198 A1* 12/2005 Kokubo ..... B41J 11/009 369/53.22
2007/0047157 A1* 3/2007 Miyahara ..... B41J 11/009 360/324.11

FOREIGN PATENT DOCUMENTS

JP 2005-186357 A 7/2005

* cited by examiner

*Primary Examiner* — Shelby Fidler
(74) *Attorney, Agent, or Firm* — Fitzpatrick, Cella, Harper & Scinto

(57) ABSTRACT

The type or surface condition of a sheet is determined with high accuracy even when performance of an optical sensor is degraded by ink mists or the like. Specifically, at the time of detecting light from a sheet with a sensor to make a determination on the sheet, at least two detection values are obtained by changing a relation between the sensor and the sheet, and the type or surface condition of the sheet is determined by using the at least two obtained detection values.

8 Claims, 10 Drawing Sheets

| SHEET TYPE | RANGE OF A RATIO OF DETECTION VALUES |
|---|---|
| PLAIN SHEET | 0.3 OR MORE |
| COATED SHEET | FROM 0.1 TO LESS THAN 0.3 |
| GLOSS SHEET | LESS THAN 0.1 |

FIG.8A

| SHEET | RATIO OF DETECTION VALUES |
|---|---|
| SHEET A | 0.33 |
| SHEET B | 0.20 |
| SHEET C | 0.09 |

FIG.8B

| SHEET TYPE | RANGE OF A RATIO OF SLOPE OF DETECTION VALUES |
|---|---|
| PLAIN SHEET | 0.7 OR MORE |
| COATED SHEET | FROM 0.3 TO LESS THAN 0.7 |
| GLOSS SHEET | LESS THAN 0.3 |

FIG.9A

| SHEET | RATIO OF SLOPE OF DETECTION VALUES |
|---|---|
| SHEET A | 1.0 |
| SHEET B | 0.5 |
| SHEET C | 0.2 |

FIG.9B

SHEET DETERMINING METHOD AND PRINTING APPARATUS

BACKGROUND OF THE INVENTION

Field of the Invention

The present invention relates to a technology of a sheet determination that determines a sheet type and a surface condition of a sheet, which is used suitably for a printing apparatus.

Description of the Related Art

Japanese Patent Laid-Open No. 2005-186357 discloses a method for determining the type of a sheet, which is used for printing, by using an optical sensor. The type of the sheet is determined by comparing an output value of the sensor with a threshold.

However, when performance of the optical sensor is degraded with the sensor having been used for a long period of time, there is a possibility that the determination of the sheet type by the set threshold is made in error. For example, in a printing apparatus of an inkjet system, ink mists float with a performance of printing and attach to optical components of the sensor (light-emitting elements, light-receiving elements or lens) to cause a light-receiving amount to be gradually smaller than the original amount.

SUMMARY OF THE INVENTION

The present invention is made based upon recognition of the foregoing problem. An object of the present invention is to provide a method that can determine a type or a surface condition of a sheet with high accuracy, even when performance of an optical sensor is degraded by ink mists or the like.

In a first aspect of the present invention, there is provided a method of detecting light from a sheet with a sensor to make a determination on the sheet, the method comprising the steps of: obtaining at least two detection values by changing a relation between the sensor and the sheet; and determining a type or a surface condition of the sheet by using the at least two detection values.

In a second aspect of the present invention, there is provided a printing apparatus comprising: a printing unit configured to print an image on a sheet; a sensor for determining the sheet used for printing; and a controlling part, wherein the controlling part performs a plurality of detections by changing a relation between the sensor and the sheet, normalizes detection values in the plurality of detections, and determines a type or a surface condition of the sheet using the result of the normalization.

According to the present invention, even when the performance of the optical sensor is degraded by the ink mist or the like, it is possible to determine the type and surface condition of the sheet with high accuracy.

Further features of the present invention will become apparent from the following description of exemplary embodiments (with reference to the attached drawings).

BRIEF DESCRIPTION OF THE DRAWINGS

FIGS. 8A and 8B are charts showing an example of a threshold range and a threshold to a ratio between the detection values according to a first embodiment in the present invention;

FIGS. 9A and 9B are charts showing an example of a threshold range and a threshold to a ratio of a slope of the detection values according to a second embodiment in the present invention.

DESCRIPTION OF THE EMBODIMENTS (First Embodiment)

Figure 1:
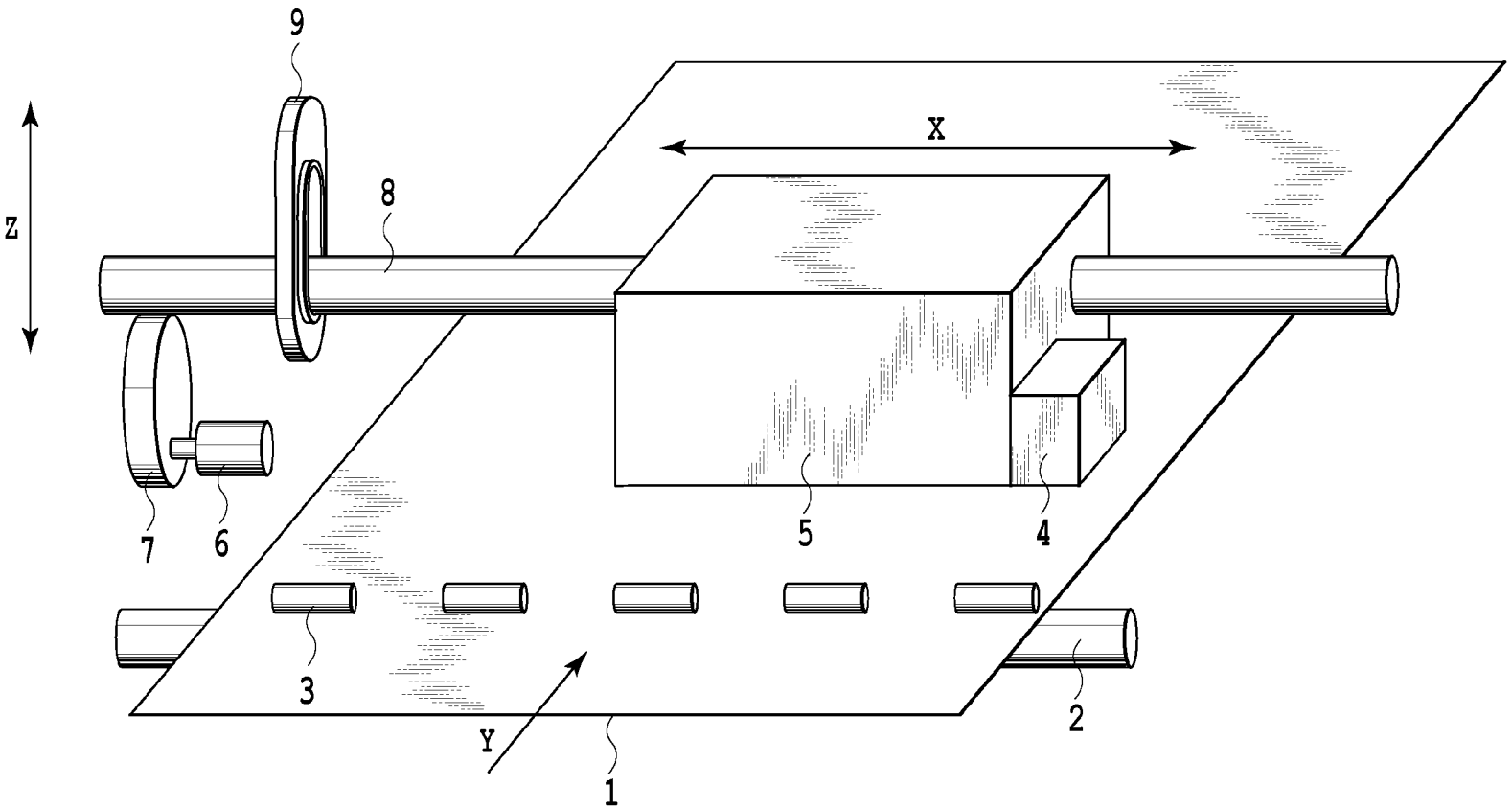
FIG. 1 is a perspective view showing a schematic configuration of a printing apparatus provided with a sheet type detecting unit according to an embodiment of the present invention.

FIG. 1 is a perspective view showing a schematic configuration of a printing apparatus provided with a sheet type detecting unit according to one embodiment in the present invention. A sheet 1 is nipped and held by a conveying roller 2 and pinch rollers 3, and is conveyed in a direction (conveying direction) shown in an arrow Y in the figure. A carriage 5 configuring a printing part is provided thereon with print heads for ejecting ink. The carriage 5 is guided by a carriage rail 8 and reciprocates in a direction (scanning direction) shown in an arrow X in the figure. The movement of the carriage 5 causes the print head to scan the sheet 1, and the print head ejects ink on the sheet 1 during the scanning so as to print an image thereon. A sensor unit 4 is attached on the carriage 5.

The sensor unit 4 is, as described later in FIG. 2 and the like, provided with a light-emitting element (light-emitting part) and a light-receiving element (light-receiving part), wherein the light-receiving element receives the light that is emitted from the light-emitting element and is then reflected on the sheet 1. The type of the sheet can be determined in accordance with the light-receiving amount. In regard to the sensor unit 4, a lifting unit that moves up and down a carriage rail 8 to change a distance of the sensor unit 4 to the sheet 1 is provided. The lifting unit is provided with a lifting mechanism 9 that guides and supports the carriage rail 8 in an upper-lower direction, a cam 7 that abuts on the carriage rail 8 and a lifting motor 6 that drives and rotates the cam 7 in the printing apparatus. When the cam 7 is rotated by the lifting motor 6 in this unit, the carriage rail 8 can move up or down along the lifting mechanism 9 in a direction shown (height direction) by an arrow Z in the figure. Therefore it is possible to change the distance between the sensor unit 4 and the sheet 1.

Figure 2:
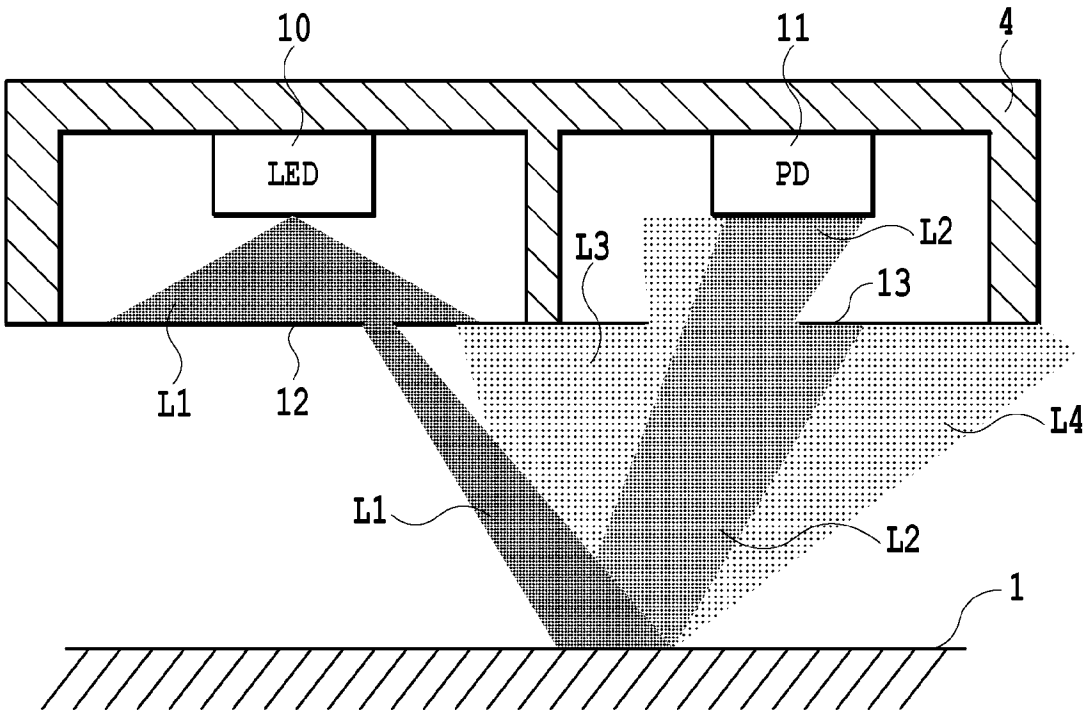
FIG. 2 is a diagram for explaining the structure of a sensor unit and a state of the light-emitting and the light-receiving according to the embodiment.

FIG. 2 is a diagram for explaining the structure of the sensor unit 4 shown in FIG. 1 and a state of the light-emitting and the light-receiving, and shows a cross section of the sensor unit 4. In FIG. 2, the sensor unit 4 is provided with an LED 10 as the light-emitting element and a photo diode 11 as the light-receiving element. Emitting light L1 from the LED 10 is narrowed in an aperture 12, and then is irradiated on the sheet 1. The light irradiated on the sheet 1 is reflected by the sheet 1, is narrowed by an aperture 13 and is received by the photo diode 11.

Figure 3A:
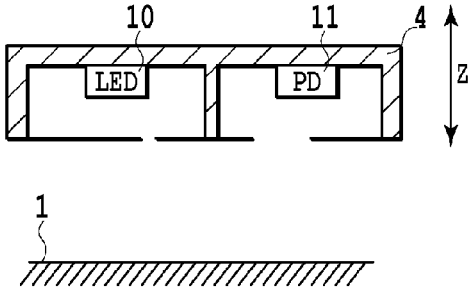
FIGS. 3A to 3F are diagrams for explaining the movement and configuration of the sensor unit according to the embodiment.

In the light-emitting and the light-receiving in the above-mentioned sensor unit 4, the reflected light is divided into light L2 as specular light, and light L3 and L4 as diffuse light. According to the embodiment of the present invention, in the sheet type determining processing, the sensor unit 4 is moved by the lifting unit described above in FIG. 1, thus differentiating a position of the sensor unit 4 in the height direction Z. FIG. 3A shows this mode in which the movement of the sensor unit 4 in the height direction Z enables the distance between the sensor unit 4 and the sheet 1 (hereinafter, also referred to as "sheet-to-sensor distance") to change. By changing the positions of the sensor unit 4 in this way, as described later in FIG. 4, the photo diode 11 can receive the specular light L2 in a position within a first range and the diffuse light L3 and L4 in a position within a second range, in relation with the aperture 13. In this way, the plurality of ranges different in reflection condition are set in the sheet type determining processing.

Figure 4:
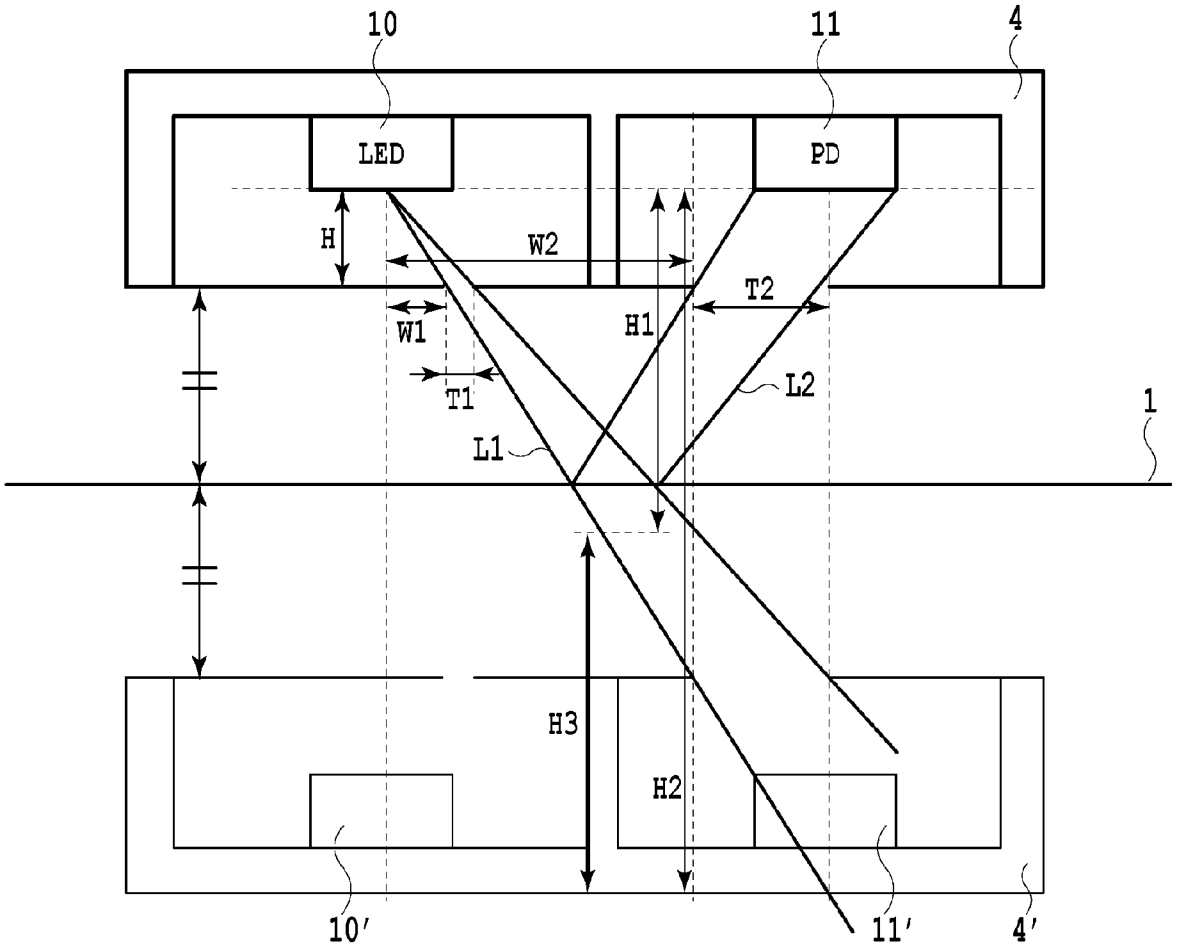
FIG. 4 is a diagram for explaining a dimension of each element in the sensor unit, the emitting range, and a distance between a sheet and the sensor unit according to the embodiment.

FIG. 4 is a diagram for explaining a dimension of each element in the sensor unit 4 and the emitting range, and a distance between the sheet and the sensor unit according to the present embodiment. In addition, in FIG. 4 a sensor unit 4' is virtually shown in a position line-symmetrical with respect to the sheet 1 in regard to the sensor unit 4.

In FIG. 4, relations of a dimension and a position of each element in the sensor unit 4 are designed such that in the case of having the sheet-to-sensor distance where the specular light L2 enters the photo diode 11 at the maximum, all the specular light passes through the aperture 13. That is, on a basis of a light-emitting position of the LED 10, when a position of an opening in the aperture 12 is indicated at W1 and the width is indicated at T1, and a position of an opening in the aperture 13 is indicated at W2 and the width is indicated at T2, the formula of "$T2=T1\times W2/W1$" is established. With this dimension relation, when the sheet-to-sensor distance is changing, there occurs the effect that a peak of the detection value appears remarkably. H3 indicates a first range (twice range thereof) as a range of the sheet-to-sensor distance where the specular light L2 can be detected by the photo diode 11. Herein when a light-emitting face of the LED 11 is set as a reference, $H1=(W2/(W1+T1))\times H$, and $H2=((W2+T2)/W1)\times H$. A range of the sheet-to-sensor distance (first range) where the specular light can enter the photo diode 11 is $M1=(H1-H)/2$ at the minimum, and $M2=(H2-H)/2$ at the maximum.

In the sheet type determining processing in the present embodiment, detection of the reflected light from the sheet is performed by the sensor unit 4 in the sheet-to-sensor distance in each of the first range where the specular light enters and a range (second range) where the diffuse light enters. In addition, the determination on the type of the sheet is made based upon the detection values.

Figure 5:
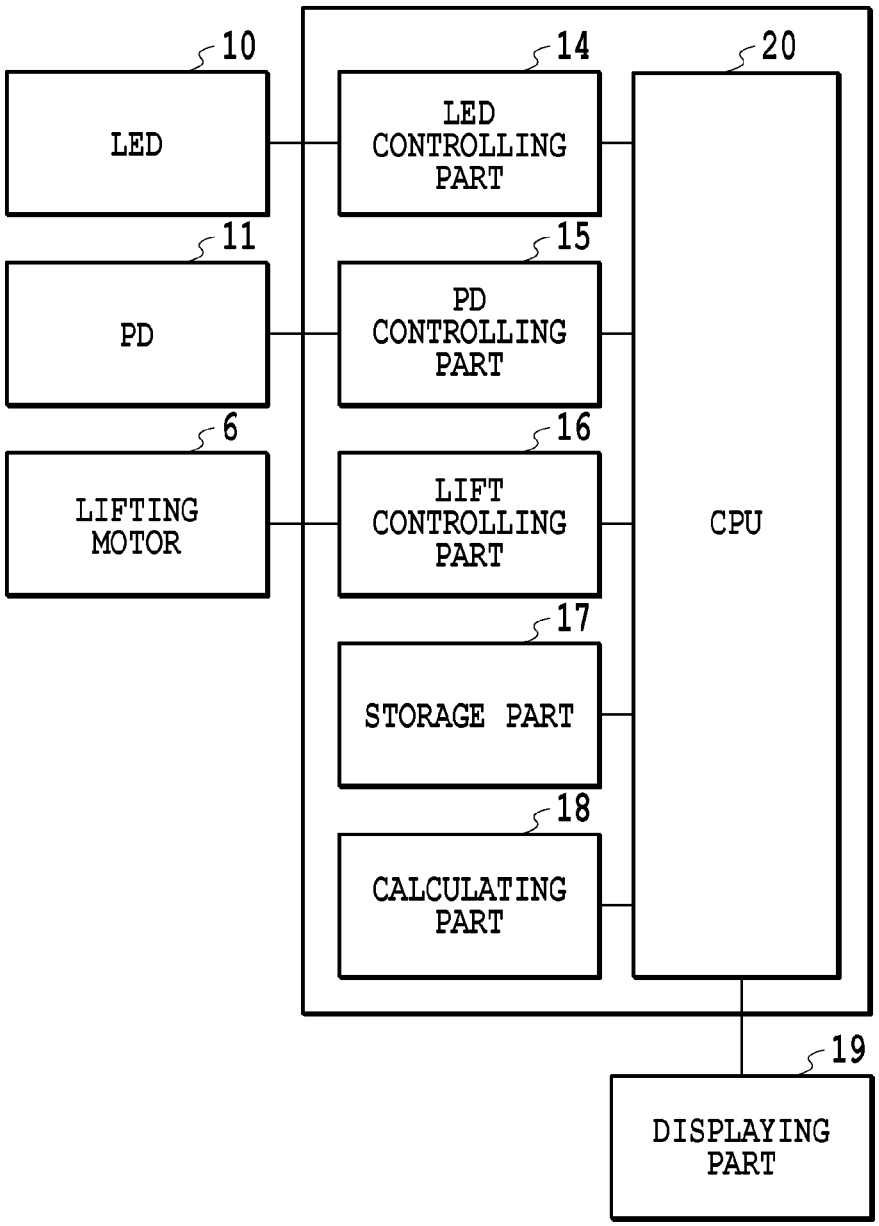
FIG. 5 is a block diagram showing the configuration of a controlling part in the printing apparatus according to the embodiment.

FIG. 5 is a block diagram showing the configuration of the controlling part in the printing apparatus. In FIG. 5, an LED controlling part 14 controls the light-emitting of the LED 10. A photo diode controlling part 15 controls the light-receiving by the photo diode 11 and output of detection values based thereupon. A lift controlling part 16 controls a drive of the lifting motor 6. The detection result by the photo diode 11 is stored in a storage part 17. A calculating part 18 calculates a ratio of the detection values stored in the storage part 17, and makes a determination on the sheet type based upon the calculation result. The determined result is displayed on a displaying part 19. A CPU 20 overall controls the processing of each of the above controlling parts.

Figure 6:
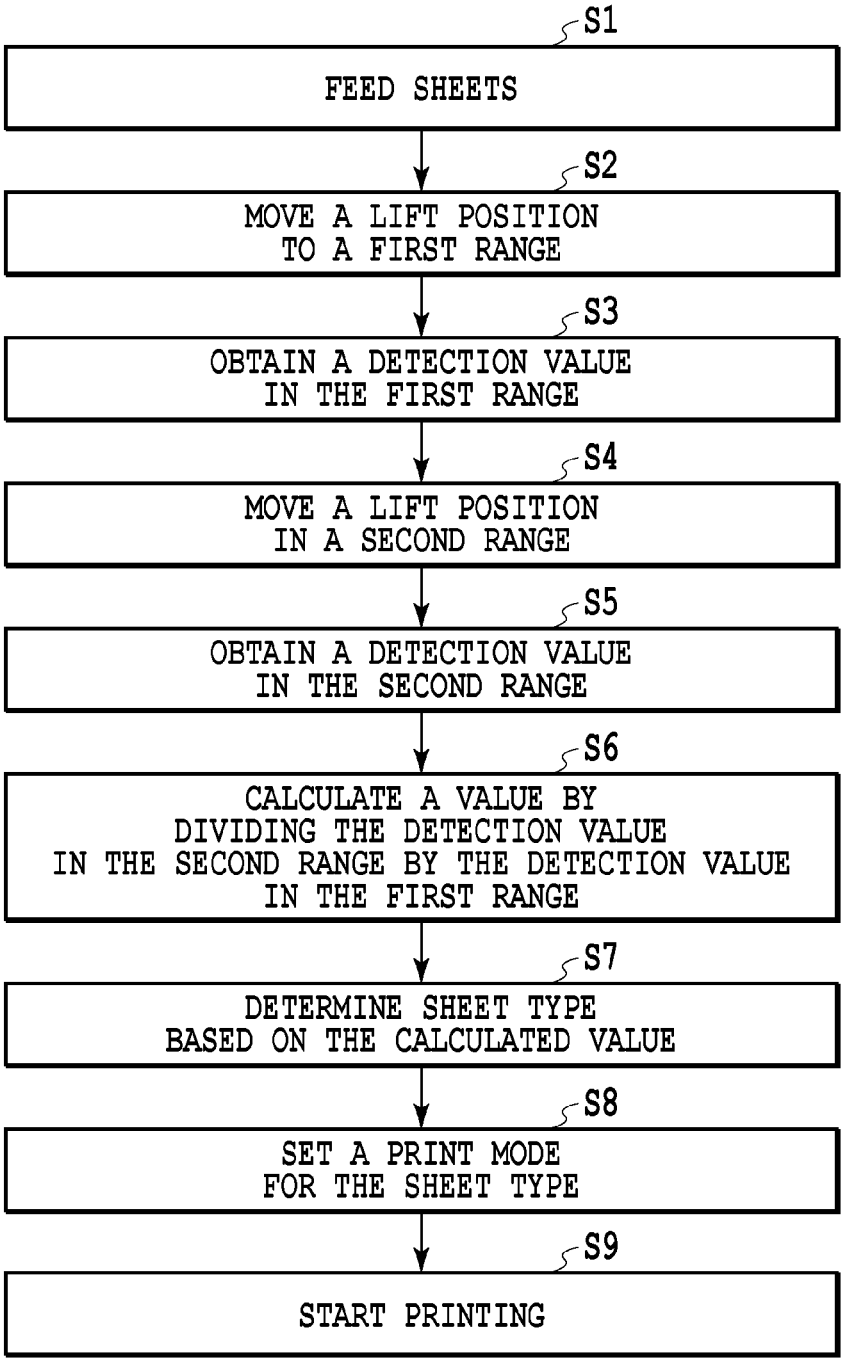
FIG. 6 is a flowchart showing sheet type determining processing according to the embodiment.

FIG. 6 is a flow chart showing the sheet type determining processing. Hereinafter, an explanation will be made of the sheet type determining sequence.

First, when a user sets a sheet to the printing apparatus, the sheet feeding is started (S1). With this sheet-feeding, the sheet 1 is conveyed until a position where the surface opposes the sensor unit 4. More specifically, the sheet 1 is conveyed until a part thereof is positioned in the movement range of the carriage 5. Next, the lifting motor 6 is driven to move the sensor unit 4 to the first range (S2). With this movement, the sheet-to-sensor distance becomes a distance where the specular light can enter the photo diode 11. Then, the LED 10 emits light, and the photo diode 11 receives the reflection of the emitted light from the sheet 1 to obtain detection values in the first range (S3). Next, the lifting motor 6 is driven to move the sensor unit 4 to the second range (S4). Then the photo diode 11 receives the reflected light from the sheet 1 to obtain detection values in the second range (S5).

Next, a value by dividing the detection value in the first range by the detection value in the second range is calculated (S6). Determination on the sheet type is made by comparing the calculation value calculated in step S6 with thresholds corresponding to the sheet types to be described later (S7). Then a print mode such as a conveying speed, a conveying amount and a print density in accordance with the sheet type, is set (S8), and the printing is started (S9).

Figure 7A:
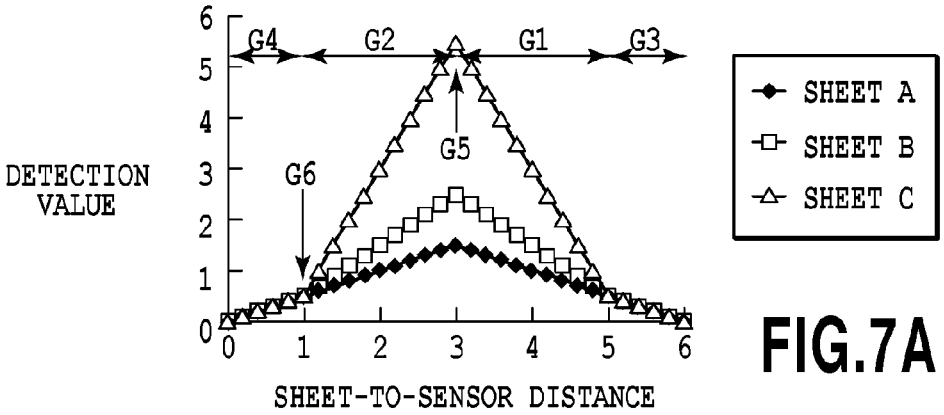
FIGS. 7A to 7C are diagrams each showing detection values, a ratio between the detection values and a difference between the detection values of a photo diode for each range.
Figure 7B:
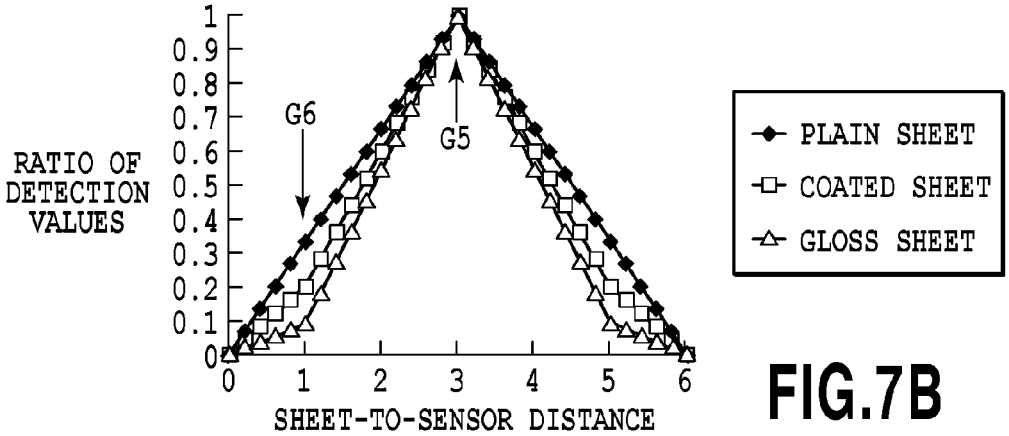
Figure 7C:
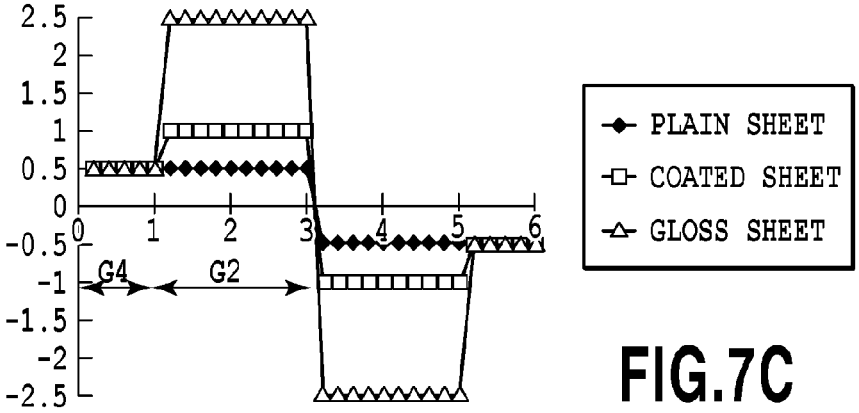

FIGS. 7A to 7C are diagrams each showing detection values, a ratio between the detection values and a slope (change rate) of the detection values in the photo diode 11 for each range according to the embodiment in the present invention.

FIG. 7A shows detection values of each of sheet A (plain sheet), sheet B (coated sheet) and sheet C (gloss sheet) by the photo diode in the case of changing the sheet-to-sensor distance. In the figure, each of G1 and G2 shows the first range where the specular light L2 enters the photo diode in regard to the sheet-to-sensor distance. On the other hand, each of G3 and G4 shows the second range where the diffuse light L3 and L4 enters the photo diode.

As optical components (such as light-emitting element, light-receiving element and lens) configuring the sensor unit are being stained with ink mists, the detection value is lowered even in the identical type of the sheet. G5 (maximum value) in a distribution curve of the detection values of each of sheet A, sheet B and sheet C is lowered with the development of the stain, and the detection value becomes smaller also in the range of each of G1 and G2. It should be noted that in the sheet-to-sensor distance in the range of each of G3 and G4 where the specular light is not received, the stain is a little and therefore has almost no influence on the sheet type determination. Therefore there is a possibility that when the stain becomes worse particularly in the range of each of G1 and G2, sheet A is erroneously determined as sheet B or sheet B is erroneously determined as sheet C. The detection values are normalized for preventing the erroneous determination by eliminating the influence of such a stain.

FIG. 7B shows a distribution curve as a result of normalizing a plurality of detection values obtained for each of the sheet-to-sensor distances for each sheet type. The values that are normalized in the detection value (maximum value) in the distance G5 where the detection value in the first range becomes the highest in each type of the sheets are shown for each sheet. In the normalization, a ratio of the detection value for each of the sheet-to-sensor distances to the detection value in G5 that is the maximum value among the plurality of detection values is calculated. That is, the plurality of detection values are converted such that the maximum value (G5) is unified as "1" in any detection value.

In the present embodiment, a ratio of the detection values obtained respectively in the distance G5 and in a distance G6 as a boundary between the first range and the second range (the detection value in G6/the detection value in G5) is used among the normalized values (ratios) shown in FIG. 7B. Then determination on the sheet type is made by comparing the dimensionless amount calculated as this ratio with a threshold in accordance with the sheet type that is the identical dimensionless amount. Even in a case where the light-receiving amount of the photo diode that is the light-receiving element is reduced by the attachment of the ink mist or the like, the normalized value does not substantially change or changes only a little thereby. Therefore the erroneous determination on the sheet type can be reduced.

FIGS. 8A and 8B are diagrams showing an example of a threshold range and a threshold to a ratio of detection values. FIG. 8A shows a range of the ratio of the detection value in the distance G6 that is the boundary between the first range and the second range to the detection value in the distance G5 where the detection value becomes the largest value in the first range for each of the sheet types of a plain sheet, a coated sheet and a gloss sheet. As shown in the figure, a range of the ratio determined as the plain sheet is 0.3 or more. Similarly a range of the ratio determined as the coated sheet is from 0.1 to less than 0.3, and a range of the ratio determined as the gloss sheet is less than 0.1. Depending on in which range the ratio of the detection value in the distance G6 to the detection value in the distance G5 to be calculated is, the sheet is determined as the sheet type in that range. Since a ratio of the detection values in sheet A is 0.33, a ratio of the detection values in sheet B is 0.20 and a ratio of the detection values in sheet C is 0.09 in the example shown in FIG. 8B, sheet A is determined as a plain sheet, sheet B is determined as a coated sheet and sheet C is determined as a gloss sheet as the determination on the sheet type.

According to the above embodiment, the determination on the sheet type is made based upon the ratio of the plurality of detection values of the photo diode. Thereby even when the detection value by the photo diode changes by mists, degradation of the optical element or the like, the erroneous determination on the sheet type can be suppressed.

It should be noted that the ratio in use is not limited to the ratio of the detection value in the distance that is the boundary between the first range and the second range to the detection value in the distance where the detection value becomes the largest value in the first range. For example, the ratio in use may be a ratio of a predetermined sheet-to-sensor distance in the first range to the detection value in the distance where the detection value becomes the largest value in the first range. In addition, the threshold in the present embodiment may be in advance set, but the ratios of the detection values of the sheets fed one time are stored in the memory, and are defined as set values, and at the time of feeding a sheet the next time, the sheet type may be determined depending on which one of the sheets previously fed has the ratio of the detection values close to that of the detection values of the sheet at the next time.

(Second Embodiment)

Next, an explanation will be made of a second embodiment in the present invention. The basic concept is configured such that the sheet type is determined by utilizing that the ratio of the slope of the distribution curve of the detection values for each range is within some range in accordance with the sheet type regardless of the stain of the sensor.

FIG. 7C shows is a diagram showing a slope (change rate) of the detection values for each sheet-to-sensor distance for each sheet type shown in FIG. 7A. A vertical axis in the graph shows a slope of a curve. The slope of the detection values in G2 that is the first range where the specular light L2 enters the photo diode can be obtained as D1, and the slope of the detection values in G4 that is the second range where the diffuse light L4 enters the photo diode can be obtained as D2. Each of D1 and D2 can be obtained as a ratio derived by measuring the detection values in two distances different within each of the ranges. Then, a ratio of D2 to D1 is evaluated, and the determination on the sheet type is made based upon this ratio. That is, the ratio (slope) of the two detection values in each of the two preset distance ranges is evaluated, and a change rate of the evaluated ratio (slope) is compared with a threshold prepared for each sheet type.

FIG. 9A shows a range in which the ratio of D2/D1 is present for each of the sheet types of a plain sheet, a coated sheet and a gloss sheet. Since a ratio of the slope of sheet A is 1.0, a ratio of the slope of sheet B is 0.5 and a ratio of the slope of sheet C is 0.2 in an example shown in FIG. 9B, sheet A is determined as a plain sheet, sheet B is determined as a coated sheet and sheet C is determined as a gloss sheet as the determination on the sheet type.

As described above, the determination on the sheet type is made based upon the ratio of the detection values in the first embodiment and based upon the ratio of the slope of the distribution curve of the detection values in the second embodiment. Further, as the other method, the determination on the sheet type may be made based upon a difference between the detection value in the first range and the detection value in the second range.

Figure 3B:
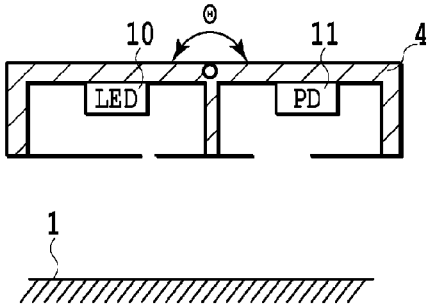
Figure 3C:
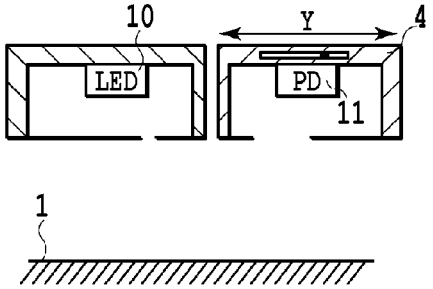

Each of the aforementioned embodiments is provided with the lifting mechanism 9 that moves the sensor unit 4 in the height direction Z, but is not limited thereto. As shown in FIG. 3B, a shift mechanism that moves the sensor unit 4 in a rotating direction θ may be provided, and detection values in the first range and detection values in the second range may be realized by changing an angle of the sensor unit 4 to the sheet 1 with this shift mechanism to detect the respective detection values. In addition, as shown in FIG. 3C, a linear mechanism that moves the photo diode 11 in the conveying direction Y may be provided, and detection values in the first range and detection values in the second range may be detected by changing a position of the photo diode 11 to the LED 10 with this linear mechanism.

Figure 3D:
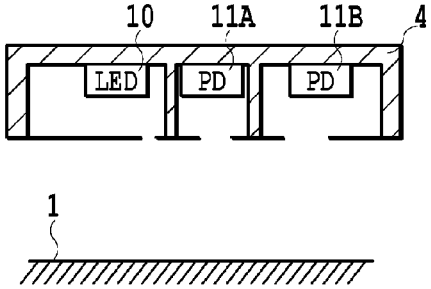
Figure 3E:
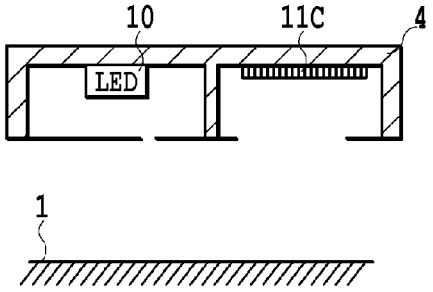
Figure 3F:
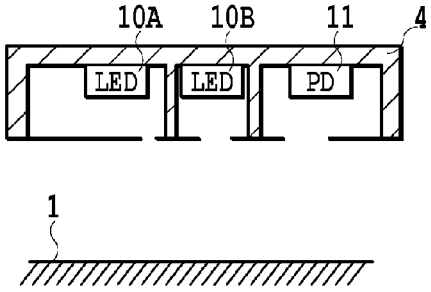

Further, as shown in FIG. 3D, a plurality of photo diodes composed of a photo diode 11A and a photo diode 11B may be provided without using the lifting mechanism 9, to detect detection values in the first range and detection values in the second range. Furthermore, as shown in FIG. 3E, the photo diode may be replaced by a line sensor 11C to detect a plurality of detection values with a plurality of portions in the line sensor. In addition, as shown in FIG. 3F, a single photo diode 11 is used, but a plurality of LEDs composed of an LED 10A and an LED 10B may be provided to detect detection values in the first range and detection values in the second range.

Figure 10:
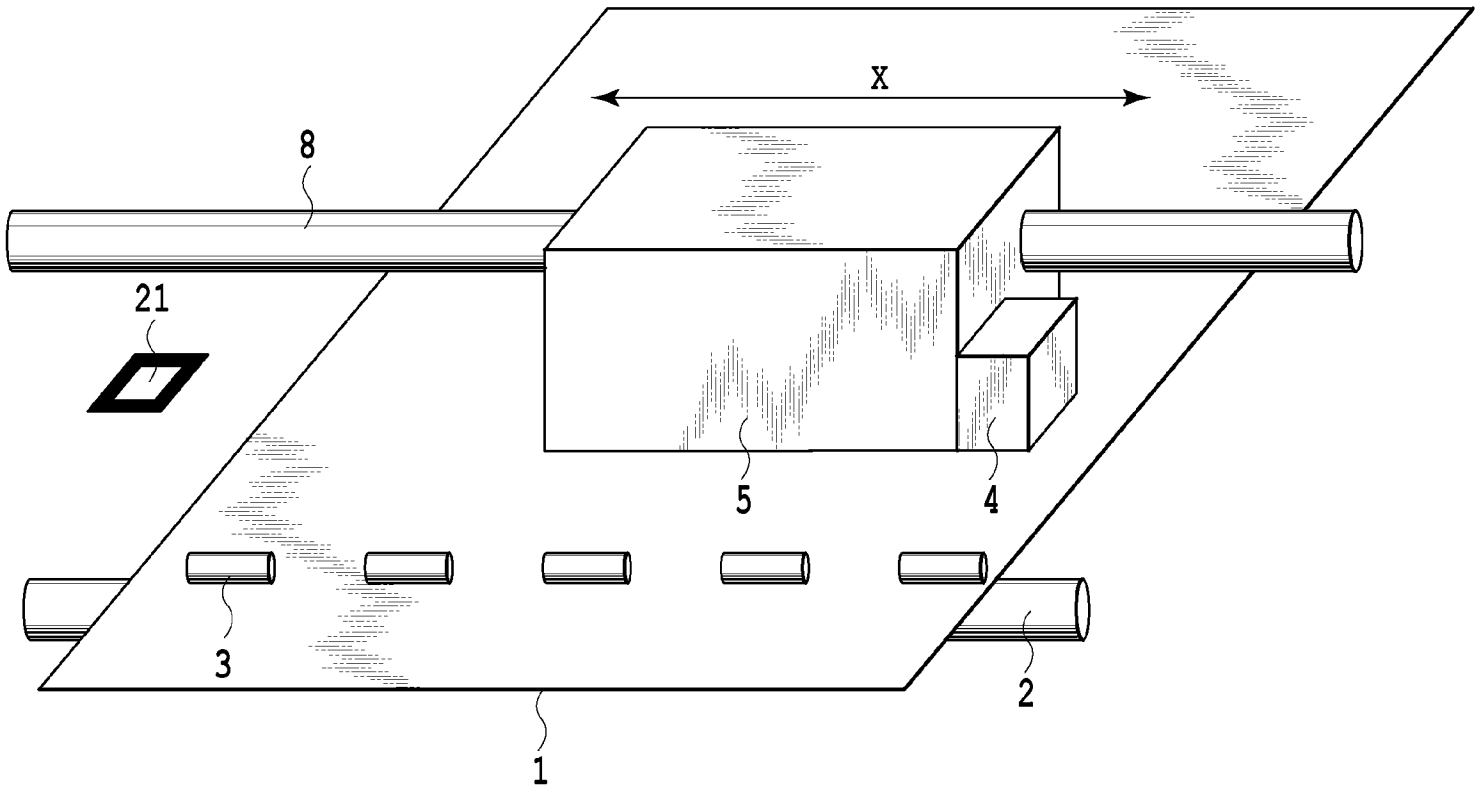
FIG. 10 is a perspective view showing a schematic configuration of a printing apparatus according to a modification.

FIG. 10 shows a modification in place of the lifting mechanism. The modification is provided with a reference calibration plate 21 as an object of an irradiated target, and a detection value of the reference calibration plate 21 is obtained as a first detection value. More specifically, in the sheet type determining processing, the carriage 5 is moved to cause the sensor unit 4 to oppose the reference calibration plate 21, and a detection value of the photo diode 11 in this position is set as a first detection value. Then, the detection value in the predetermined sheet-to-sensor distance of the sheet 1 that is detected as described above is obtained as a second detection value. Then a ratio of the first detection value and the second detection value is calculated, and determination on the sheet type is made by comparing the calculated ratio with a threshold.

It should be noted that a platen that supports the sheet may be used as a detection target in place of the reference calibration plate. Since a surface of the platen generally has a black color and has almost no change in color due to an influence of mists, it is preferable to use the platen as a reference.

In addition, according to the above embodiments, the type of the sheet is determined from the surface condition of the sheet, but the surface condition (glossy degree, stain or the like) of the sheet to be used may be determined without determining the sheet type. Further, the sheet determination other than the above-mentioned may be made.

In the embodiments described above, at least the two detection values are obtained by changing the positional relation between the sensor and the sheet, at the time of making the determination on the sheet by detecting the light from the sheet with the sensor. Then the two detection values are used to determine the type or surface condition of the sheet, based upon the normalization concept. By the normalization, even when the performance of the optical sensor is degraded due to ink mists or the like, the extent that the degraded performance has an effect on the sheet determination becomes small. As a result, it is possible to determine the type or surface condition of the sheet with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-082940, filed Apr. 14, 2014, which is hereby incorporated by reference herein in its entirety.

What is claimed is:

1. A method of detecting light from a sheet with a sensor to make a determination on the sheet, said method comprising the steps of:

obtaining at least two detection values by changing a distance between the sensor and the sheet; and evaluating a ratio of two detection values within two different distance ranges, respectively, and comparing a change rate of the evaluated ratios at the two different distance ranges with a threshold to determine a type or a surface condition of the sheet.

2. The method according to claim 1, wherein the two detection values are obtained, respectively, in a positional relation between the sensor and the sheet in which specular light from the sheet enters a light-receiving part of the sensor, and in a positional relation between the sensor and the sheet in which the specular light does not enter the light-receiving part of the sensor.

3. The method according to claim 1, wherein the sensor is mounted on a carriage that reciprocates, the carriage being moved by a mechanism that changes a position of the sensor.

4. The method according to claim 1, wherein the detection value of the sheet used in a previous determination is stored in a memory, and a determination on the next sheet is made by a detection value of the next sheet and the detection value stored in the memory.

5. A printing apparatus comprising:

a printing unit configured to print an image on a sheet;

a sensor unit configured to detect information from the sheet used for printing, the sensor unit being capable of changing a distance relative to the sheet; and a controller, wherein the controller performs detections by changing the distance between the sensor unit and the sheet to obtain at least two detection values, and evaluates a ratio of two detection values within two different distance ranges, respectively, and compares a change rate of the evaluated ratios at the two different distance ranges with a threshold to determine a type or a surface condition of the sheet.

6. The apparatus according to claim 5, further comprising a carriage on which the sensor unit is mounted and a mechanism for moving the carriage, the carriage being configured to reciprocate and the mechanism being configured to change the distance between the sensor unit and the sheet.

7. The apparatus according to claim 6, wherein the two detection values are obtained, respectively, in a positional relation between the sensor unit and the sheet in which specular light from the sheet enters a light-receiving part of the sensor unit, and in a positional relation between the sensor unit and the sheet in which the specular light does not enter the light-receiving part of the sensor unit.

8. The apparatus according to claim 6, wherein the carriage mounts an inkjet print head to perform printing of the image on the sheet.

* * * * *